US005810360A

United States Patent [19]

Srichayaporn

[11] Patent Number: 5,810,360

[45] Date of Patent: Sep. 22, 1998

[54] METHOD FOR PLAYING A NON-BANKING BLACKJACK GAME

[76] Inventor: Songsak Srichayaporn, 1526 E. Minton Dr., Mesa, Ariz. 85282-7312

[21] Appl. No.: 842,731

[22] Filed: Apr. 16, 1997

[51] Int. Cl.[6] ..... A63F 1/00

[52] U.S. Cl. ..... 273/292

[58] Field of Search ..... 273/292, 274

[56] References Cited

U.S. PATENT DOCUMENTS

| | | | |
|---|---|---|---|
| 5,249,809 | 10/1993 | Wolf | 273/274 |
| 5,257,789 | 11/1993 | LaVasseur | 273/309 |
| 5,275,415 | 1/1994 | Wisted | 273/292 |
| 5,275,416 | 1/1994 | Schorr et al. | 273/292 |
| 5,397,128 | 3/1995 | Hesse et al. | 273/292 |
| 5,413,353 | 5/1995 | Demarest et al. | 273/292 |
| 5,437,462 | 8/1995 | Breeding | 273/292 |
| 5,494,296 | 2/1996 | Grassa | 273/292 |
| 5,503,401 | 4/1996 | Nguyen | 273/306 |
| 5,540,442 | 7/1996 | Orselli et al. | 463/17 |
| 5,544,892 | 8/1996 | Breeding | 273/292 |
| 5,566,946 | 10/1996 | Parker | 273/292 |

OTHER PUBLICATIONS

Scarne's Encyclopedia of Games, John Scarne, Harper & Row Publishers, "Pontoon", p. 286, Dec. 1973.

The Fresno Bee, Nov. 10, 1992, "Blackjack introduced at Table Mountain" by Royal Calkins.

*Primary Examiner*—Benjamin H. Layno

*Attorney, Agent, or Firm*—Schmeiser, Olsen & Watts

[57] ABSTRACT

According to the present invention, a method for playing a non-banking Blackjack game is disclosed. A card game played according to a preferred embodiment of the present invention is somewhat similar in spirit to traditional Blackjack. However, using the present invention, the individual players do not play against the house, instead, the players are pitted against each other. Each player station has a first betting location, a second betting location and a third betting location. To begin play players place their initial bets in their first betting location. After the initial bets have been placed, each player is dealt a first card. Each player then has the option to place a second bet in their second betting location. After the second bets have been placed each player is dealt a second card. Each player then has the option to place a third bet in their third betting location. Each player may then draw additional cards or stand. To resolve the bets, all players compare their final hands to determine a first winner. Then only the players that placed a bet in the second betting location compare their final hands to determine a second winner. Then only the players that placed in the third betting location compare their hands to determine a third winner. This provides an advantage in that a game played according to a preferred embodiment of the present invention allows for increased excitement to be generated as the players compete and bet against each other. Finally, the inclusion of wildcards increases the element of chance and enhances the possibility of a player getting a Blackjack.

12 Claims, 2 Drawing Sheets

METHOD FOR PLAYING A NON-BANKING BLACKJACK GAME

BACKGROUND OF THE INVENTION

1. Technical Field

This invention generally relates to the field of gaming and more specifically relates to a method of playing cards.

2. Background Art

The game of "Blackjack" or "Twenty-One" is perhaps the most popular card game played in gaming establishments and casinos throughout the United States. This game is typically played with a standard deck of playing cards containing fifty-two cards in four different suits. The object of the game is for each player to collect a number of cards in their hand whereby the total point value assigned to the cards in a player's hand is as close as possible to twenty-one without going over. Numbered cards (i.e. 2–10) are assigned a numerical value equal to their face value and face cards (i.e. king, queen, and jack) are assigned a numerical value of ten points each. If the point value in a player's hand exceeds 21 at any time, the player "busts" and is eliminated from further play until a winner is declared and the next hand is dealt.

Blackjack is typically played at tables that include a location for a dealer and up to seven additional players. Each player places a bet and, along with the dealer, initially receives two cards. In traditional Blackjack, each player is playing against the dealer or "house." The dealer or house acts as the bank, paying all losses and collecting all winnings from the other players at the table. In order to win his bet, the cards in a player's hand must have a higher total point value than the total point value of the cards in the dealer's hand without going over 21.

During a player's turn, a player may elect to draw additional cards (i.e. take a "hit") or play only the cards currently held in his hand ("stand"). A player may continue to receive additional cards, trying to reach a point total of 21 without exceeding 21. It is not necessary to reach a point total of 21 exactly to win the game, however. It is only necessary to come closer to the point total of 21 than the dealer. Since the dealer receives one of his two initial cards face down (i.e. a "hole" card), the players know only half of the cards in the dealer's initial hand. This adds an element of uncertainty to a player's decision to take a hit or to stand.

The risk of "busting" by taking an additional card increases as the point total of the cards in the player's hand approaches 21. A player increases the probability of beating the dealer's card total by selectively and strategically hitting or standing on a particular card situation. Under most house rules, the dealer, however, must take a hit on any point total of 16 or less and must stand on any point total of 17 or more. Each player at the table who comes closer to a point total of 21 than the dealer without exceeding 21 wins their bet. Conversely, each player who "busts" or who does not achieve a higher point total than the dealer, loses the hand and the corresponding wager for that hand. A "Blackjack" occurs when a player or the dealer receives an ace and a face card or ten. A Blackjack by the dealer ends the game, causing all other players to lose their bets. A Blackjack for a player is the best possible hand for the player and beats the dealer, unless the dealer also has a Blackjack. Ties between the player and the dealer are a "push" and are typically won by the house. Players at a Blackjack table will typically play multiple successive hands and players may enter and leave the game at any time between hands.

Although Blackjack is a very popular card game, there are many areas of the country where Blackjack cannot be played in regulated gaming establishments and casinos. For example, in Arizona, there are many gambling casinos which are operated on Federal Indian Reservations under the auspices of the National Indian Gaming Commission (NIGC). According to the current laws governing these gaming establishments, traditional Blackjack and other "dealer bank" games may not be played because they are categorized as class III games under the Indian Gaming Regulatory Act (IGRA).

In view of this, it would be desirable to have a Blackjack game where the dealer did not operate as the bank, thereby creating a game which could be approved for use on Federal Indian Reservations. This would increase the revenue for the casinos and provide additional opportunities for gaming enjoyment for the patrons of the establishments. In addition, new and exciting variations of existing games are useful to stimulate interest and to attract new customers to casinos.

There has been at least one previous attempt to provide a non-banking Blackjack game for casinos. U.S. Pat. No. 5,413,353 issued to Demarest describes a Blackjack-type game where the players play against each other instead of the house. However, this game is played almost exactly like regular Blackjack in that it provides the same basic betting patterns and strategies for the players to pursue. While the basic Blackjack game play can be enjoyable, alternate betting strategies would add variety and increased interest to game play.

In addition, without a constant influx of new and stimulating gaming options and opportunities, many casino customers have a tendency to lose interest in the casino and will generally seek entertainment elsewhere. Therefore, what is needed is a non-banking Blackjack game which can offer a variety of stimulating betting options and other variations to generate customer interest in the game and continued entertainment for the patrons of the casinos.

DISCLOSURE OF INVENTION

According to the present invention, a method and apparatus for playing a non-banking Blackjack game is disclosed. A card game played according to a preferred embodiment of the present invention is somewhat similar in spirit to traditional Blackjack. However, using the present invention, the individual players do not play against the house, instead, the players are pitted against each other. In addition, the timing of the betting, the style of betting and the total number of bets allowed is modified, thereby increasing betting options and strategies. Since the players are playing against each other, the game play is substantially different than traditional Blackjack. Further, the increased complexity of the various betting options also significantly influences game play dynamics as players try to decide whether to hit or stand. This provides an advantage in that a game played according to a preferred embodiment of the present invention allows for increased excitement to be generated as the players compete and bet against each other. Finally, the inclusion of wildcards increases the element of chance and enhances the possibility of a player getting a Blackjack.

Another advantage of the present invention is that a game played according to a preferred embodiment of the present invention has been classified as a class II card game by the NIGC under the IGRA and, accordingly, is approved for play in Arizona Indian casinos. This allows the casinos to attract new customers and to offer a very popular game for the player's enjoyment.

The foregoing and other features and advantages of the present invention will be apparent from the following more particular description of preferred embodiments of the invention, as illustrated in the accompanying drawings.

BRIEF DESCRIPTION OF DRAWINGS

The preferred embodiments of the present invention will hereinafter be described in conjunction with the appended drawings, wherein like designations denote like elements, and.

BEST MODE FOR CARRYING OUT THE INVENTION

Figure 1:
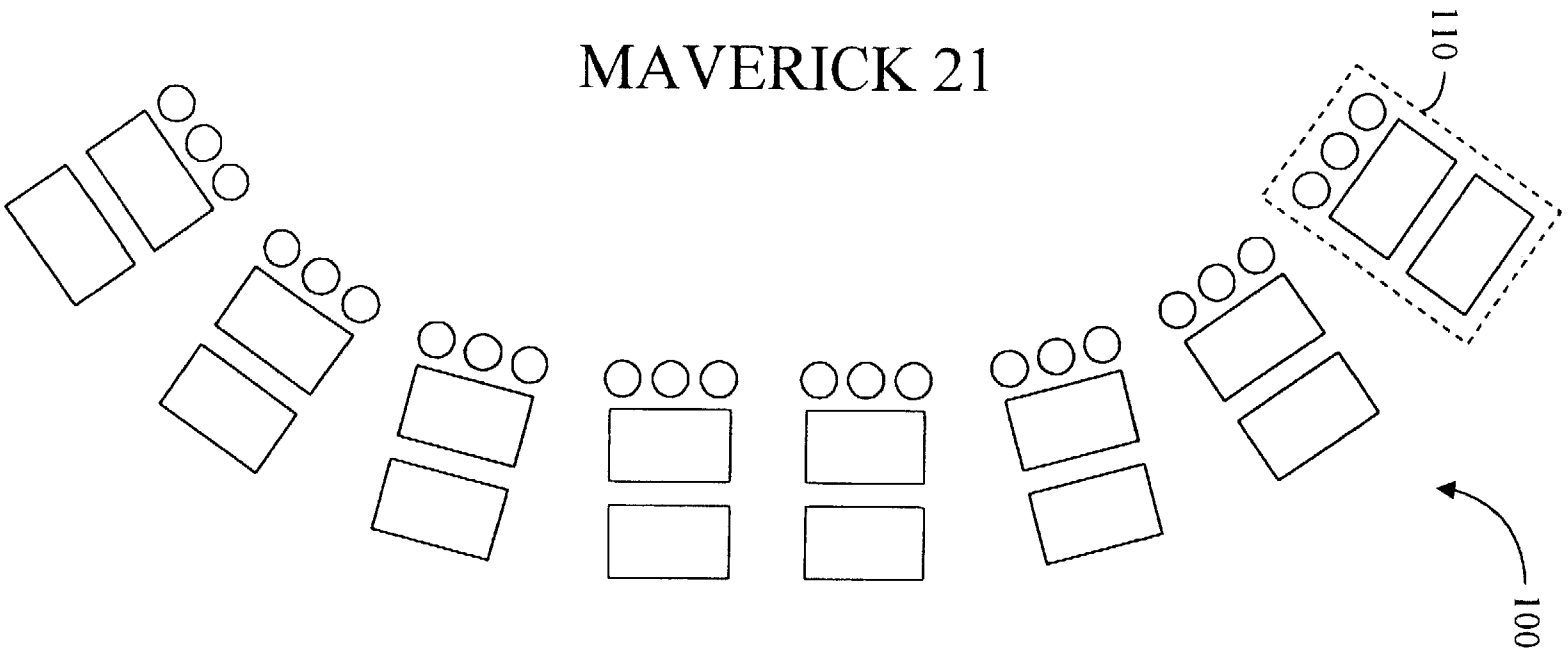
FIG. 1 is a plan view of a table layout with eight player stations designed to be used with a preferred embodiment of the present invention.

According to the present invention, a method and apparatus for playing a non-banking Blackjack game is disclosed. A card game played according to a preferred embodiment of the present invention is somewhat similar in spirit to traditional Blackjack. However, using the present invention, the individual players do not play against the house, instead, the players are pitted against each other. In addition, the timing of the betting, the style of betting and the total number of bets allowed is modified, thereby increasing betting options and strategies. Since the players are playing against each other, the game play is substantially different than traditional Blackjack. Further, the increased complexity of the various betting options also significantly influences game play dynamics as players try to decide whether to hit or stand. This provides an advantage in that a game played according to a preferred embodiment of the present invention allows for increased excitement to be generated as the players compete and bet against each other. Finally, the inclusion of wildcards increases the element of chance and enhances the possibility of a player getting a Blackjack.

The following definitions apply to playing a non-banking blackjack game played according to a preferred embodiment of the present invention.

1. "Blackjack" means an ace and a second card with a point value of ten dealt as the initial two cards to a player. Blackjack may not include an ace and a second card with a point value of ten dealt to a player who has split pairs. When played with jokers, Blackjack can include an ace and a joker or a face card and a joker.

2. "Dealer Button" means an object which is moved clockwise around the table to denote which player is the dealer.

3. "Deal" means the distribution of the playing cards among the players.

4. "Dealer" means the person responsible for dealing the cards at the table.

5. "Hard Total" means the total point count of a hand which contains no aces or which contains aces that are counted as one in value.

6. "Soft Total" means the total point value of a hand containing an ace or a joker when the ace or the joker is counted as eleven in value, or a hand containing a joker when the joker is counted as a face card.

7. "Rake" or "Rake Off" means a predetermined amount taken from each of the various betting locations which are claimed by the house or casino where the game is being played. The rake can be calculated as a percentage of the winning pot, a percentage of a broke hand, a fixed ante, or some other method determined by the house or casino.

8. "Shoe" means a dealing device that has a compartment in which cards are stacked and which permits cards to be dealt at any given time.

9. "Showdown" means the revealing of each player's hand in order by the dealer after the last card has been dealt, thereby determining the winner.

10. "Natural" means a player's hand comprised of an ace and a face card (Blackjack) or, if wild cards are used, a hand comprised of a face card and a joker or a hand comprised of an ace and a joker.

A non-banking Blackjack game according to a preferred embodiment of the present invention may be played with a standard deck of cards, containing 52 cards. The standard deck of cards will have four different suits (typically hearts, clubs, diamonds, and spades), with 13 cards in each suit. Every suit will include, respectively, cards numbered from 2–10, a jack, a queen, a king, and an ace. Alternatively, another preferred embodiment of the present invention may be played with a standard deck of cards which also includes two "jokers" or wildcards. If jokers are employed, they are typically used as wildcards and may be played as either a face card or an ace, at the receiving player's discretion. While a preferred embodiment of the game may be played with a single deck, it is important to note that at many casinos, multiple decks of cards may be placed into a single dealing shoe and used to play the game of Blackjack. Similarly, the game of the present invention may be played in a similar fashion. Standard casino dealing shoes may be used if desired.

A game according to a preferred embodiment of the present invention may be played by two to eight players and is played at a gaming table with a specified layout which facilitates the game play such as the layout shown in FIG. 1. Referring now to FIG. 1, a table layout 100 in accordance with a preferred embodiment of the present invention includes eight player stations 110. A game using table layout 100 and played in accordance with a preferred embodiment of the present invention will accommodate any number of game players from two to eight. Each player will select a player station 110 and will receive their cards and place their bets from their respective player station 110. The detailed explanation of each player station 110 is described below in conjunction with FIG. 2.

Figure 2:
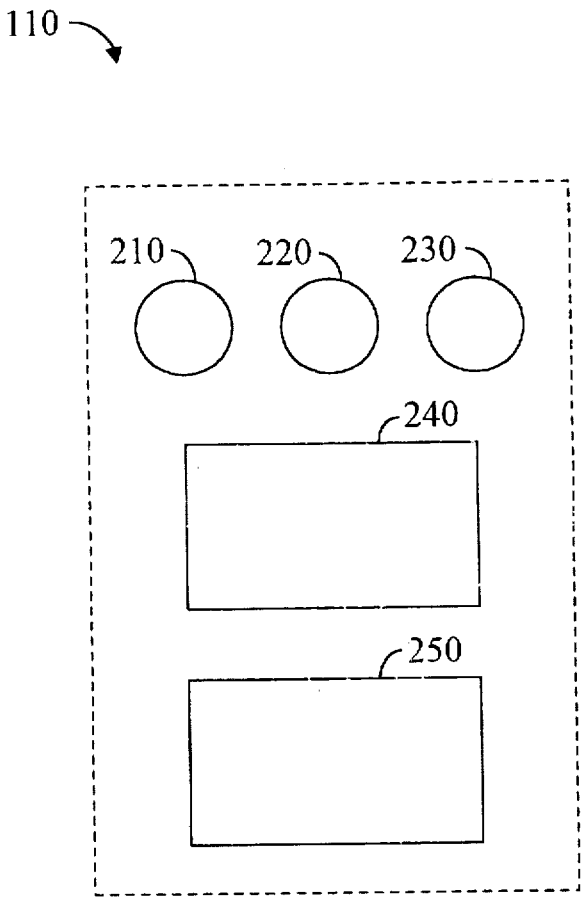
FIG. 2 is a plan view of a single player station from FIG. 1.

Referring now to FIG. 2, an individual player station 110 according to a preferred embodiment of the present invention includes: a first betting location 210; a second betting location 220; a third betting location 230; a "stand" card placement location 240; and a "hit" card placement location 250. First betting location 210 is where each player is required to place their initial bet or "ante." Betting locations 220 and 230 are used to place alternate, optional bets in addition to the ante. The minimum and maximum allowable betting amounts allowed or required for each betting location are determined by the players or the casino. Game play begins after each player has placed their initial bets.

Referring now to FIGS. 1 and 2, each player at a player location 110 is dealt two cards, with at least one of the cards being dealt face down. After the first two cards, any additional cards will be dealt to the players face up. After receiving the first two cards, each player in turn, starting with the player to the left of the dealer, may draw additional cards or stand. Once a player is satisfied with the point total in their hand and has decided to stand, the player places the cards in his or her hand into stand card placement location 240. This signals the dealer that the player does not wish to receive any more cards. Alternatively, if a player wishes to receive additional cards, the player should leave his or her cards in hit card placement location 250. This signifies to the dealer that the player wishes to receive additional cards during their turn. Once a player decides to stand and moves their cards from hit card placement location 250 to stand card placement location 240, then their turn ends and they will not receive any additional cards. A player will continue to receive additional cards until they either 1) move their cards to stand card placement location 240, or, 2) or until the point total in their hand exceeds 21 and they bust.

Following completion of the deal, and after any subsequent draws by the players, a showdown is initiated with the dealer turning over each of the players cards and announcing the card sums for each of the player's hand. A winning hand held by a player allows the player to collect the pot minus a predetermined rake collected by the house. If two or more players have equivalent hands, the winning players simply split the pot evenly between the winning players. If the split cannot be identical (i.e. $51 dollars to split between two players), any odd amount is paid to the player closest to the dealer button. Additionally, if two or more players receive a Blackjack on the first two cards, then a tie is declared for all players with a Blackjack for all betting locations where the players with a Blackjack have placed their wagers. Following completion of the game and the pay out of the wagers, another hand is dealt and another game is initiated.

The starting point of the deal moves in a clockwise direction around the playing table by using a dealer button. This helps to equalize the odds between the players over the course of several games. In game play, cards are dealt to the left of the player where the dealer button is placed. At the conclusion of each hand, the dealer button is advanced in a clockwise fashion to the next player, signifying the dealer for the next hand. A player must have played at least one hand at the table before being allowed to receive the dealer button and before serving as the dealer.

The use of second betting location 220 and third betting location 230 is very flexible. For example, a game according to a preferred embodiment of the present invention may require all players to place a bet in any one or all three of the betting locations before any cards are dealt. Alternatively, the players may only be required to place an initial bet in first betting location 210 before any cards are dealt. Then, after each player has received a first card, the players may, optionally, place a second bet in second betting location 220. Then, after each player has received a second card, each player may, optionally, place a bet in third betting location 230. This allows players to increase their bets as they receive their cards and as they begin to employ strategies for game play. Additionally, players may place additional bets to "bluff" or fool their opponents into thinking a player's hand is close to 21.

In another game play betting scenario, betting locations 220 and 230 may be used to increase the stakes for certain hands of the game by allowing all players to place bets in each of the three betting locations before any cards are dealt. This increases the risk of the game and can provide high rollers a chance to win or lose sizeable sums of money be wagering larger amounts on certain hands.

Another option with the three betting locations is to enhance "backline" betting. Backline betting occurs when a spectator wishes to place a bet on the game at the table without actually being a participant in receiving cards. The backline better may use the second or third betting location to place bets on a player's hand and thereby participate in the game without receiving cards. This will increase the excitement of the game and allow more people to be involved. All of the betting options described above can be used singly or in various combinations.

Since betting location 220 and betting location 230 typically represent optional bets, only those player's hands that correspond to the players who placed optional bets are competing against each other. For example, while all players at the table are required to place a minimum wager in first betting location 210, in one scenario it may be that only two players place bets in second betting location 220 and three other players place bets in third betting location 230. In this case, all players hands are compared to determine the winner of the bets placed in first betting location 210. However, only the two hands for the two players who placed bets in second betting location 220 will be compared when determining the winner of the bets placed in second betting location 220. Similarly, only the three hands for the three players who placed bets in third betting location 230 will be compared when determining the winner of the bets placed in second betting location 230. In this way, a wide variety of betting options are provided for the players and backline betters. This betting action also allows individuals to selectively bet smaller or larger sums of money, depending on their own individual levels of risk tolerance and allows relatively timid gamblers to play at the same table with more adventurous gamblers.

Another option for the present game includes using "jackpot" scoring to increase a player's chance of winning. In jackpot scoring, certain card combination is a player's hand are rewarded with a scoring payout from the house. For example, if a player has a 3 and a 7 of the same suit in a given hand, they can be declared a jackpot winner, even if they do not achieve a point total of 21. Alternatively, if a player is dealt a 6, 7, and 8 of the same suit (for a total of 21) they may be declared a jackpot winner and receive a bonus from the house in addition to any winnings from reaching a point total of 21. Another example would be to award a jackpot to any player who is dealt three naturals in a row. Obviously, many additional alternative jackpot scenarios can be devised.

Another betting option allows players to place unequal bets in each of the three betting locations. For example, a first player may place an optional bet of $100 in second betting location 220 and a second player may place an optional bet of $50 in second betting location 220 at their respective player stations 110. If the first player wins the hand, then the first player will collect player two's entire $50 bet. However, if the second player wins the hand, then the second player will only collect an amount equal to their own bet. In this case, the second player would collect $50 of the first player's bet and the remainder would be returned to the first player. This strategy allows players with different financial resources to bet against each other.

While the invention has been particularly shown and described with reference to preferred embodiments thereof, it will be understood by those skilled in the art that various changes in form and details may be made therein without departing from the spirit and scope of the invention.

I claim:

1. A method of playing a non-banking blackjack game using at least one standard deck of 52 playing cards plus two jokers, the method comprising the steps of:

two to eight players placing a first wager in a first betting location;

a dealer dealing a first card face down to each of the two to eight players;

at least two of the two to eight players placing a second wager in a second betting location;

the dealer dealing a second card face up to each of the two to eight players;

at least two of the two to eight players placing a third wager in a third betting location;

each of the two to eight players electing in turn to stand or draw additional cards, with the final number of cards held by each of the two to eight players comprising that respective player's hand;

determining a card sum from each of the two to eight players' hands by adding the point value for each card in the player's hand, wherein a card having a face value from 2 to 10 is counted at its face value, a jack, queen, or king is counted as 10, an ace is counted as either 1 or 11, and the jokers being treated as either a face card or an ace;

comparing each of the two to eight players card sums and determining a first winner or winners, wherein determining a first winner or winners is based on the first winner or winners having a card sum that does not exceed 21 but exceeds that of every other player; paying the wagers in the first betting location to the first winner or winners;

comparing the card sums for all players who placed a wager in the second betting location and determining a second winner or winners, wherein determining a second winner or winners is based on the second winner having a card sum that does not exceed 21 but exceeds that of every other player who placed a wager in the second betting location;

paying the wagers in the second betting location to the second winner;

comparing the card sums for all players who placed a wager in the third betting location and determining a third winner or winners, wherein determining a third winner or winners is based on the winner or winners having a card sum that does not exceed 21 but exceeds that of every other player who placed a wager in the third betting location;

paying the wagers in the third betting location to the third winner or winners.

2. The method of claim 1 further comprising the step of declaring a jackpot winner.

3. The method of claim 2 wherein the jackpot winner is any player who has a 3 and 7 of the same suit in their hand.

4. The method of claim 2 wherein the jackpot winner is any player who has a 6, 7, and 8 of the same suit in their hand or any player who has been dealt 3 naturals in a row.

5. The method of claim 1 further comprising the step of at least one individual who is not one of the two to eight players placing a wager in at least one of the first, second or third betting locations.

6. The method of claim 1 further comprising the step of at least two of the two to eight players placing wagers of different amounts in at least one of the three betting locations.

7. A method of playing a non-banking blackjack game using at least one standard deck of 52 playing cards, the method comprising the steps of:

two to eight players placing a first wager in a first betting location;

a dealer dealing a first card face down to each of the two to eight players;

at least two of the two to eight players placing a second wager in a second betting location;

the dealer dealing a second card face up to each of the two to eight players;

at least two of the two to eight players placing a third wager in a third betting location;

each of the two to eight players electing in turn to stand or draw additional cards, with the final number of cards held by each of the two to eight players comprising that respective player's hand;

determining a card sum from each of the two to eight players' hands by adding the point value for each card in the player's hand, wherein a card having a face value from 2 to 10 is counted at its face value, a jack, queen, or king is counted as 10, and an ace is counted as either 1 or 11;

comparing each of the two to eight players card sums and determining a first winner or winners, wherein determining a first winner or winners is based on the first winner or winners having a card sum that does not exceed 21 but exceeds that of every other player;

paying the wagers in the first betting location to the first winner or winners;

comparing the card sums for all players who placed a wager in the second betting location and determining a second winner or winners, wherein determining a second winner or winners is based on the second winner having a card sum that does not exceed 21 but exceeds that of every other player who placed a wager in the second betting location;

paying the wagers in the second betting location to the second winner or winners;

comparing the card sums for all players who placed a wager in the third betting location and determining a third winner or winners, wherein determining a third winner or winners is based on the winner or winners having a card sum that does not exceed 21 but exceeds that of every other player who placed a wager in the third betting location;

paying the wagers in the third betting location to the third winner or winners.

8. The method of claim 7 further comprising the step of declaring a jackpot winner.

9. The method of claim 7 wherein the jackpot winner is any player who has a 3 and 7 of the same suit in their hand.

10. The method of claim 7 wherein the jackpot winner is any player who has a 6, 7, and 8 of the same suit in their hand or any player who has been dealt 3 naturals in a row.

11. The method of claim 7 further comprising the step of at least one individual who is not one of the two to eight players placing a wager in at least one of the first, second or third betting locations.

12. The method of claim 7 further comprising the step of at least two of the two to eight players placing wagers of different amounts in at least one of the three betting locations.

* * * * *